US007311092B1

(12) United States Patent
Ling

(10) Patent No.: US 7,311,092 B1
(45) Date of Patent: Dec. 25, 2007

(54) TORSION-ENHANCING APPARATUS

(76) Inventor: Ming-Te Ling, No. 198, Shuyi Rd., South Dist., Taichung (TW)

( * ) Notice: Subject to any disclaimer, the term of this patent is extended or adjusted under 35 U.S.C. 154(b) by 0 days.

(21) Appl. No.: 11/633,556

(22) Filed: Dec. 5, 2006

(51) Int. Cl.
*F02M 23/00* (2006.01)

(52) U.S. Cl. ..... 123/587

(58) Field of Classification Search ..... 123/184.21, 123/585, 587, 198 E
See application file for complete search history.

(56) References Cited

U.S. PATENT DOCUMENTS 5,140,957 A * 8/1992 Walker ..... 123/198 E
5,347,973 A * 9/1994 Walker, Jr. ..... 123/574
5,479,907 A * 1/1996 Walker, Jr. ..... 123/573
6,009,846 A * 1/2000 Walker, Jr. ..... 123/198 E
6,287,355 B1 * 9/2001 Park ..... 55/419
6,382,197 B1 * 5/2002 Matsumoto ..... 123/585
6,475,255 B1 * 11/2002 Walker, Jr. ..... 55/315
7,131,434 B2 * 11/2006 Waiser ..... 123/587
2003/0145839 A1 * 8/2003 Wu ..... 123/587
2006/0162687 A1 * 7/2006 Amburgy ..... 123/198 E

* cited by examiner

*Primary Examiner*—Hai Huynh
(74) *Attorney, Agent, or Firm*—Birch, Stewart, Kolasch & Birch, LLP

(57) ABSTRACT

A torsion-enhancing apparatus has a mounting bracket, a vacuum bracket and two air filters. The mounting bracket has a threaded hole, a first connecting tube and two ventilating holes. The threaded hole is formed in the front end and the first connecting tube is connected to the rear end of the mounting bracket. The vacuum bracket is connected to the mounting bracket, and has a rear cap, a front cap, a diaphragm, a spring and a pressing disk. The rear cap is connected to the front end of the mounting bracket. The front cap is connected to the rear cap and has a third connecting tube, an adjusting bolt and a sealing ring. The diaphragm is mounted between the caps. The spring is mounted in the caps between the adjusting bolt and the diaphragm. The air filters are connected to the second connecting tubes of the mounting bracket.

4 Claims, 5 Drawing Sheets

TORSION-ENHANCING APPARATUS

BACKGROUND OF THE INVENTION

1. Field of the Invention

The present invention relates to a torsion-enhancing apparatus and more particularly to a torsion-enhancing apparatus that can increase the torsion of an engine.

2. Description of Related Art

With reference to FIG. 5, a conventional torsion-enhancing apparatus is used on a car between an engine and an inlet manifold to import air into the engine to increase the torsion and economize the fuel when the car is started. The conventional torsion-enhancing apparatus comprises a mounting bracket (50), a vacuum bracket (60) and an air filter (70).

The mounting bracket (50) is cylindrical, is connected to the car by a belt and has a front end, a rear end, an external surface, a threaded hole (51), a connecting tube (52), an annular groove (53) and a connecting hole (54). The threaded hole (51) is formed in the front end of the mounting bracket (50). The connecting tube (52) is connected to the rear end of the mounting bracket (50) and communicates with the threaded hole (51) and is attached to the inlet manifold of the car. The annular groove (53) is defined in the external surface of the mounting bracket (50) between the front end and the rear end, and the belt is mounted around the annular groove (53) to connect the mounting bracket (50) with the car. The connecting hole (54) is formed in the external surface of the mounting bracket (50) and is communicated with the threaded hole (51).

The vacuum bracket (60) is connected to the inlet manifold of the car and the mounting bracket (50), and has a rear cap (61), a front cap (62), a diaphragm (63) and a spring (64). The rear cap (61) is connected to the front end of the mounting bracket (50) and has a proximal end (611). The proximal end (611) is screwed with the threaded hole (51) of the mounting bracket (50) and has two through holes. The front cap (62) is connected to the rear cap (61) to form a chamber between the caps (61,62) and has a free end, a setscrew hole (621), an adjusting bolt (622) and a connecting tube (623). The setscrew hole (621) is formed in the free end of the front cap (62) and is communicated with the chamber. The adjusting bolt (622) is screwed with the setscrew hole (621) and extends into the chamber between the caps (61, 62). THe connecting tube (623) is formed on the free end of the front cap (62), communicates with the chamber and is connected to the inlet manifold of the car. The diaphragm (63) is mounted in the chamber between the rear cap (61) and the front cap (62). The spring (64) is mounted in the chamber between the adjusting bolt (622) and the diaphragm (63).

The air filter (70) is screwed with the connecting hole (54) of the mounting bracket (50).

However, the conventional torsion-enhancing apparatus has the following defects and shortcomings.

1. The adjusting bolt (622) is screwed with the setscrew hole (621), and a gap is existed between the adjusting bolt (622) and the setscrew hole (621). The air may leak through the gap easily and this may influence the vacuum effect between the front cap (62) and the rear cap (61) and the efficiency of the engine.

2. When the proximal end (611) of the rear cap (61) is screwed with the threaded hole (51) of the mounting bracket (50), so the through holes of the proximal end (611) may not communicate directly with the connecting hole (54). Consequently, the air may not flow smoothly from the air filter (70) into the mounting bracket (50). Thus, the amount of the air flowing in the mounting bracket (50) may decrease, and the efficiency of the engine will be decreased.

3. The connecting tubes (52, 623) are connected to the inlet manifold, and the mounting bracket (50) is connected to the car by the belt. However, the mounting bracket (50) is cylindrical and may be rolled and moved when the car is running.

The torsion-enhancing apparatus in accordance with the present invention mitigates or obviates the aforementioned problems.

SUMMARY OF THE INVENTION

The main objective of the present invention is to provide a torsion-enhancing apparatus that can increase the torsion of an engine.

The torsion-enhancing apparatus has a mounting bracket, a vacuum bracket and two air filters. The mounting bracket has a threaded hole, a first connecting tube and two ventilating holes. The threaded hole is formed in the front end and the first connecting tube is connected to the rear end of the mounting bracket. The vacuum bracket is connected to the mounting bracket, and has a rear cap, a front cap, a diaphragm, a spring and a pressing disk. The rear cap is connected to the front end of the mounting bracket. The front cap is connected to the rear cap and has a third connecting tube, an adjusting bolt and a sealing ring. The diaphragm is mounted between the caps. The spring is defined in the caps between the adjusting bolt and the diaphragm. The air filters are connected to the second connecting tubes of the mounting bracket.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
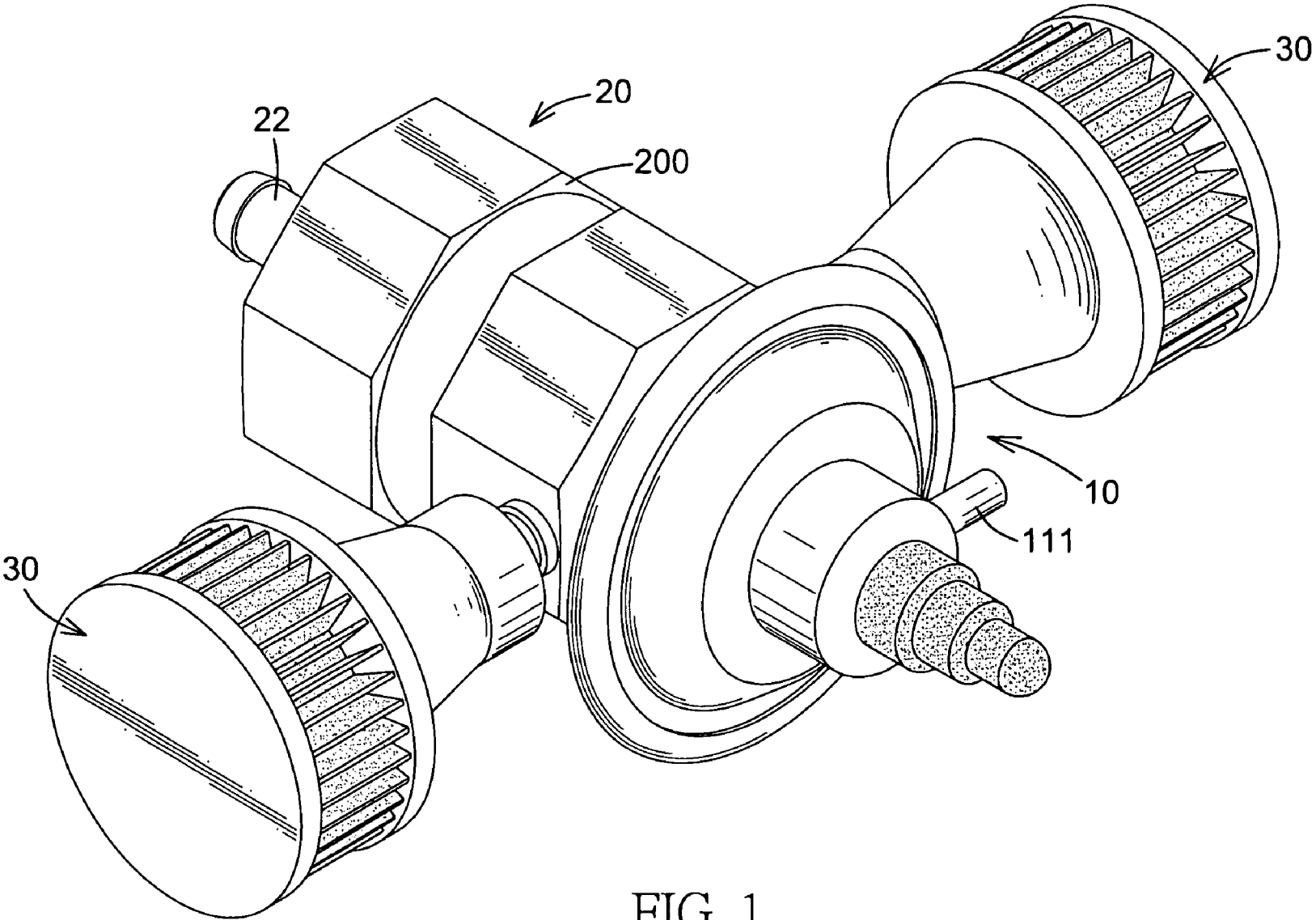
FIG. 1 is a perspective view of a torsion-enhancing apparatus in accordance with the present invention.
Figure 2:
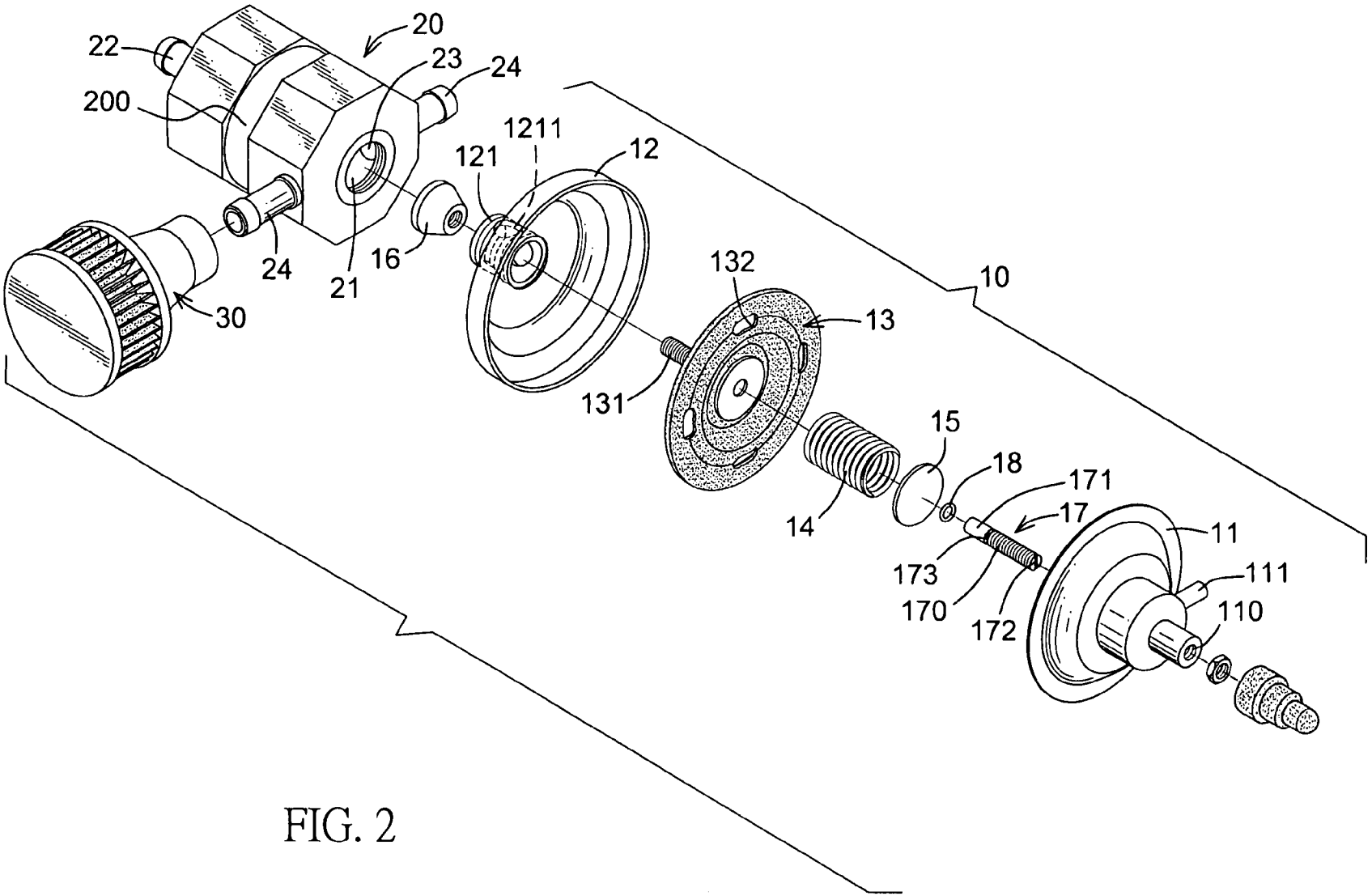
FIG. 2 is an exploded perspective view of the torsion-enhancing apparatus in FIG. 1.
Figure 3:
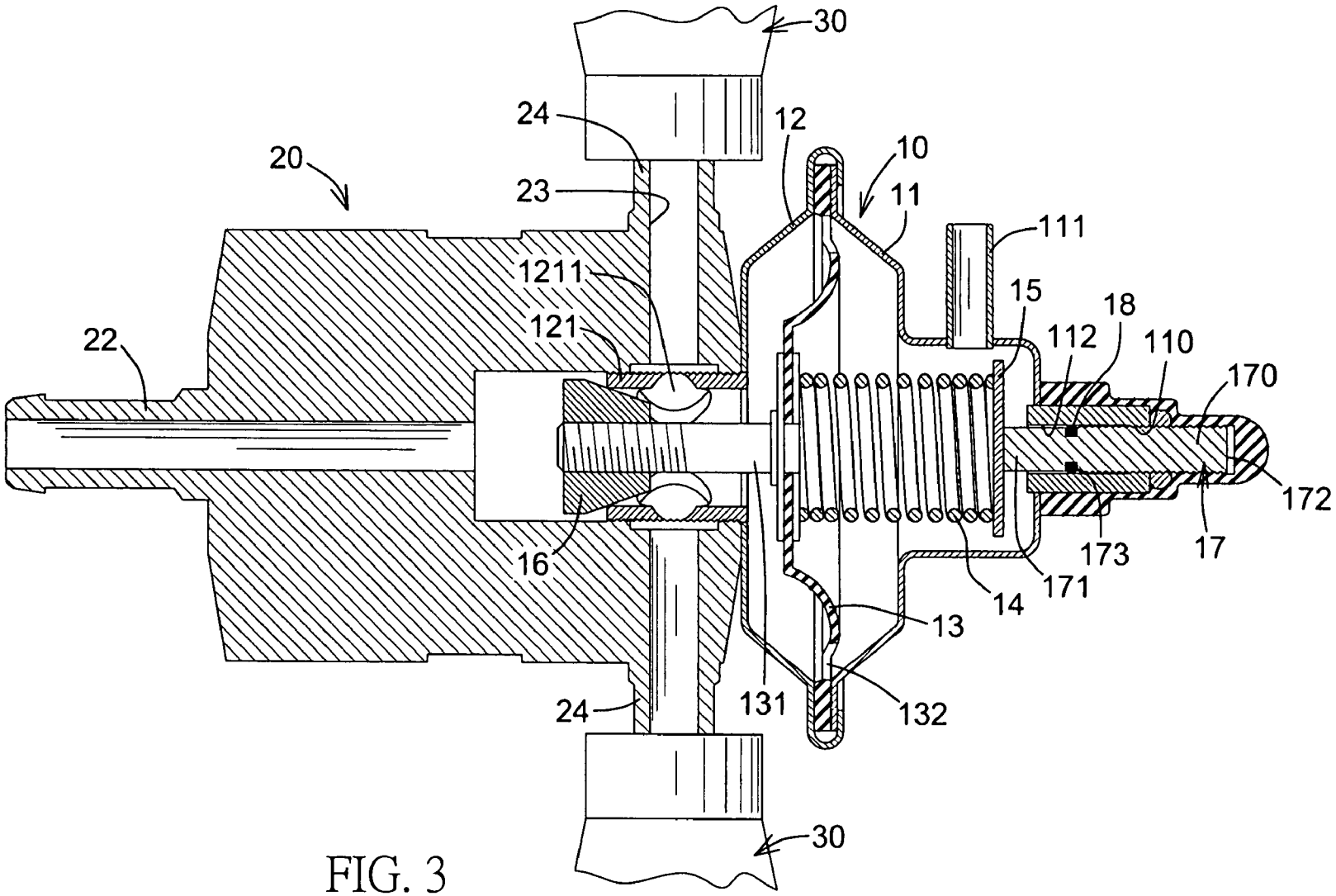
FIG. 3 is a cross sectional top view of the torsion-enhancing apparatus in FIG. 1.
Figure 4:
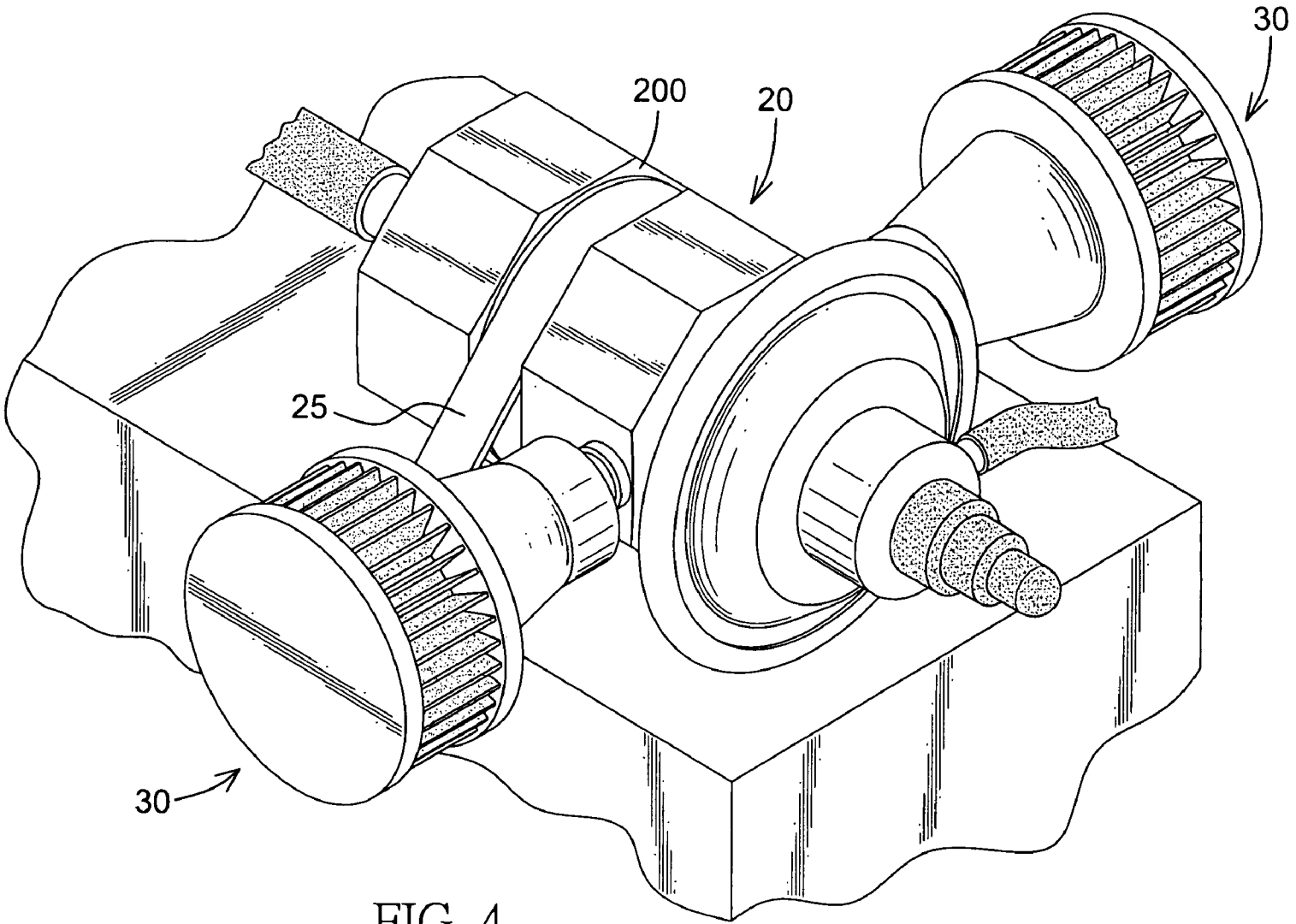
FIG. 4 is an operational perspective view of the torsion-enhancing apparatus in FIG. 1 mounted on an engine.
Figure 5:
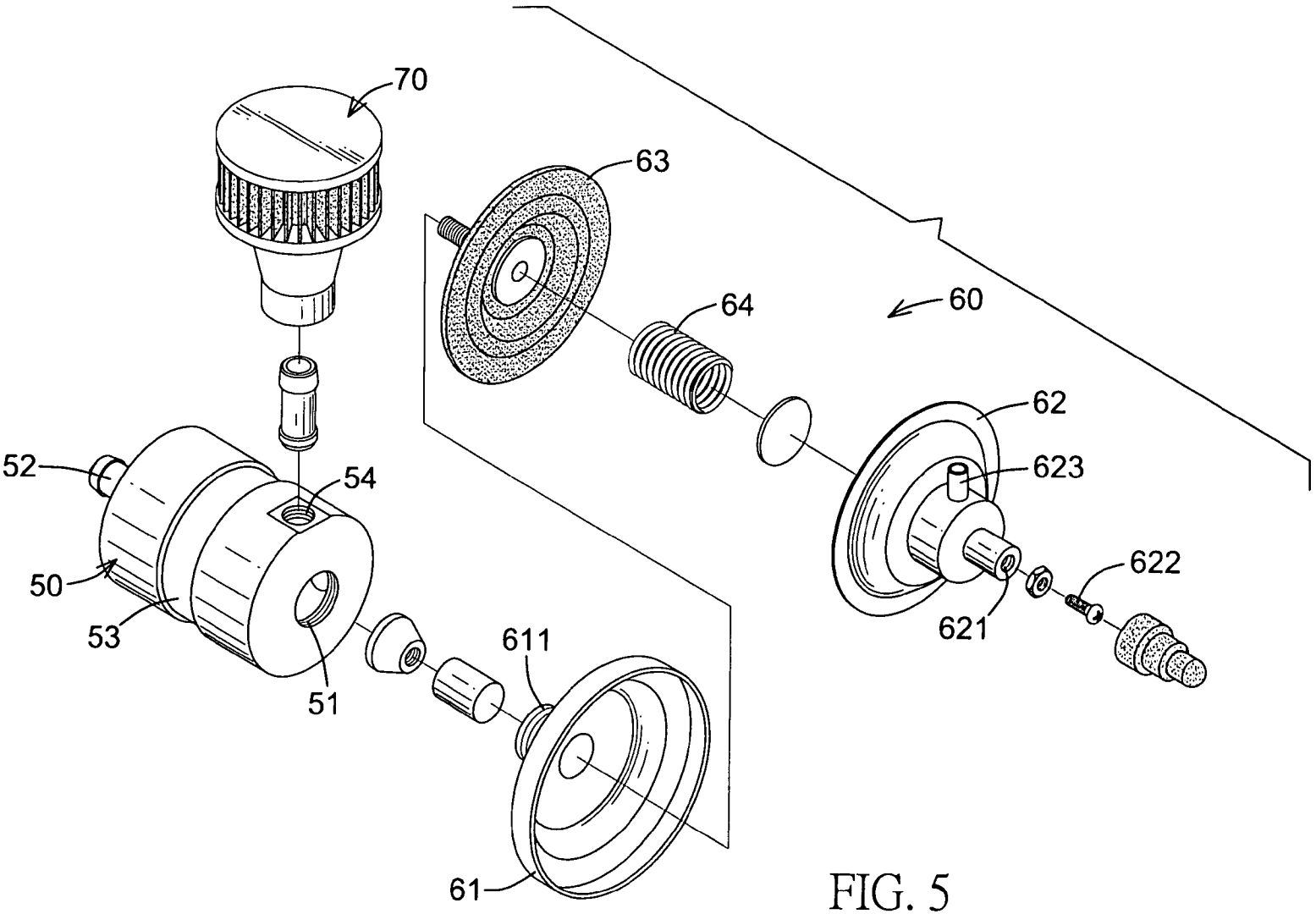
FIG. 5 PRIOR ART
FIG. 5 is an exploded perspective view of a conventional torsion-enhancing apparatus in accordance with the prior art.

With further reference to FIGS. 1 to 4, the torsion-enhancing apparatus in accordance with the present invention used on a car having a engine, a inlet manifold and a body comprises a mounting bracket (20), a vacuum bracket (10) and two air filters (30). The inlet manifold is connected to the engine, is used to import air into the engine and has two ends.

The mounting bracket (20) is hollow, is connected to a car and has a front end, a rear end, a chamber, an external surface, an annular groove (200), a belt (25), a threaded hole (21), a first connecting tube (22), two ventilating holes (23) and two second connecting tubes (24).

The annular groove (200) is formed around the external surface of the mounting bracket (20) between the front end and the rear end. The belt (25) is mounted around the annular groove (200) to connect the mounting bracket (20) with the car. The external surface of the mounting bracket (20) is polygonal. In preferred embodiment, the external surface of the mounting bracket (20) is octagonal and is contacted to the body of the car by the belt (25). The threaded hole (21) is formed in the front end of the mounting bracket (20) and communicates with the chamber. The first connecting tube (22) is connected to the rear end of the mounting bracket (20) and communicates with the chamber, is attached to one end of the inlet manifold in the car. The ventilating holes (23) are formed in the external surface of the mounting bracket (20) near the front end and are communicated with the chamber of the mounting bracket (20). The second connecting tubes (24) are respectively connected to the ventilating holes (23).

The vacuum bracket (10) is connected to the inlet manifold of the car and the mounting bracket (20), and has a rear cap (12), a front cap (11), a diaphragm (13), a spring (14) and a pressing disk (15).

The rear cap (12) is connected to the front end of the mounting bracket (20) and has a proximal end, a mounting tube (121) and a plug (16). The mounting tube (121) is hollow, is formed on the proximal end of the rear cap (12), is connected to threaded hole (21) of the mounting bracket (20) and has an external surface, a thread and three through holes (1211). The thread is formed on the external surface of the mounting tube (121) and is screwed with the threaded hole (21) of the mounting bracket (20). The through holes (1211) are formed radically through the mounting tube (12) and two of the through holes (1211) are communicated with the ventilating holes (23) in the mounting bracket (20). The plug (16) is mounted in the chamber of the mounting bracket (20) and contacts with the mounting tube (121) of the rear cap (12).

The front cap (11) is connected to the rear cap (12) to form a chamber and has a side, a mounting pipe, a third connecting tube (111), an adjusting bolt (17) and a sealing ring (18). The mounting pipe is formed on the free end of the front cap (11), is communicated with the chamber between the caps (11, 12) and has an inner end, an outer end, an internal surface (112) and an inner thread (110). The inner end of the mounting pipe is connected to the side of the front cap (11). The inner thread (110) is formed on the internal surface (112) near the outer end of the mounting pipe. The third connecting tube (111) is formed radically on the free end of the front cap (11), communicates with the chamber between the caps (11, 12) and is connected to the other end of the inlet manifold in the car.

The adjusting bolt (17) is connected to the mounting pipe of the front cap (11), extends into the chamber between the caps (11, 12) and has a pressing end (171), an operating end (172), a sealing groove (173) and an external thread (170). The pressing end (171) is extended into the chamber between the caps (11, 12) via the mounting pipe. The operating end (172) is extended out the outer end of the mounting pipe. The sealing groove (173) is formed around the adjusting bolt (17) between the pressing end (171) and the operating end (172). The external thread (170) is formed around the adjusting bolt (17) between the operating end (172) and the sealing groove (173) and is screwed with the inner thread (110) of the mounting pipe. The sealing ring (18) is mounted around the sealing groove (173) and contacts with the internal surface (112) between the inner thread (110) and the inner end of the mounting pipe.

The diaphragm (13) is mounted in the chamber between the caps (11, 12) and has a front side, a rear side, a threaded post (131) and multiple through holes (132). The threaded post (131) is formed on the rear side of the diaphragm (13), extends into the mounting tube (121) of the rear cap (12) and is connected to the plug (16). The through holes (132) are formed through the diaphragm (13) and used to transmit heat in the vacuum bracket (10).

The spring (14) is mounted in the chamber between the caps (11, 12) between the adjusting bolt (17) and the front side of the diaphragm (13). The pressing disk (15) is connected to and abuts with the pressing end (171) of the adjusting bolt (17) and the spring (14).

The air filters (30) are respectively connected to the second connecting tubes (24) of the mounting bracket (20) to import air into the chamber of the mounting bracket (20) and flowing to the first connecting tube (21) and the inlet manifold in the car.

The torsion-enhancing apparatus has the following advantages.

1. With the arrangement of the sealing ring (18) mounted around the sealing groove (173) and contacting with the internal surface (112) between the inner thread (110) and the inner end of the mounting pope, the air leakage from the gaps between the inner thread (110) of the mounting pipe and the external thread (170) of the adjusting bolt (17) is prevent. Therefore, a vacuum effect between the front cap (11) and the rear cap (12) is well kept and the efficiency of the engine is improved.

2. When the mounting tube (121) of the rear cap (12) is screwed with the threaded hole (21) of the mounting bracket (20), the through holes (1211) of the mounting tube (121) will communicate directly with the ventilating holes (23) and the second connecting tubes (24). Accordingly, the air can flow smoothly from the air filters (30) into the mounting bracket (20). Thus, the amount of the air flowing in the mounting bracket (20) will increase, and the efficiency of the engine will be improved.

3. The external surface of the mounting bracket (20) is polygonal, such that the mounting bracket (20) will not be rolled and moved when the car is running.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A torsion-enhancing apparatus comprising a mounting bracket being hollow and having a front end;

a rear end;

a chamber;

an external surface;

a threaded hole being formed in the front end of the mounting bracket and communicated with the chamber;

a first connecting tube being connected to the rear end of the mounting bracket and communicated with the chamber; and two ventilating holes being formed in the external surface of the mounting bracket near the front end and being communicated with the chamber of the mounting bracket;

a vacuum bracket being connected to the mounting bracket and having a rear cap being connected to the front end of the mounting bracket and having a proximal end;

a mounting tube being formed on the proximal end of the rear cap, being connected to threaded hole of the mounting bracket and having an external surface;

a thread being formed on the external surface of the mounting tube and being screwed with the threaded hole of the mounting bracket; and three through holes being formed radically through the mounting tube and two of the through holes being communicated with the ventilating holes in the mounting bracket; and a plug being mounted in the chamber of the mounting bracket and contacting with the mounting tube of the rear cap;

a front cap being connected to the rear cap to form a chamber between the rear and front caps and having a side;

a mounting pipe being formed on the side of the front cap, being communicated with the chamber of the caps and having an inner end being connected to the side of the front cap;

an outer end;

an internal surface; and an inner thread formed on the internal surface near the outer end of the mounting pipe;

a third connecting tube being formed radically on the free end of the front cap and communicated with the chamber between the rear and front caps;

an adjusting bolt being connected to the mounting pipe of the front cap, being extended into the chamber between the rear and front caps and having a pressing end being extended into the chamber between the rear and front caps via the mounting pipe;

an operating end being extended out the outer end of the mounting pipe;

a sealing groove being formed in the adjusting bolt between the pressing end and the operating end; and an external thread being formed around the adjusting bolt between the operating end and the sealing groove and being screwed with the inner thread of the mounting pipe; and a sealing ring being mounted around the sealing groove, contacting with the internal surface between the inner thread and the inner end of the mounting pipe;

a diaphragm being mounted in the chamber between the rear and front caps and having a front side;

a rear side; and a threaded post being formed on the rear side of the diaphragm, being extended into the mounting tube of the rear cap and connected to the plug;

a spring being mounted in the chamber of the rear and front caps between the adjusting bolt and the front side of the diaphragm; and a pressing disk being connected to and abutting with the pressing end of the adjusting bolt and the spring; and two air filters being connected to the mounting bracket and communicated with the ventilating holes.

2. The torsion-enhancing apparatus as claimed in claim 1, wherein the mounting bracket has two second connecting tubes respectively connected to the ventilating holes;

the air filters are respectively connected to the second connecting tubes of the mounting bracket; and the diaphragm has multiple through holes formed through the diaphragm.

3. The torsion-enhancing apparatus as claimed in claim 2, wherein the mounting bracket has an annular groove being formed around the external surface of the mounting bracket between the front end and the rear end; and a belt being mounted around the annular groove; and the external surface of the mounting bracket being octagonal.

4. The torsion-enhancing apparatus as claimed in claim 1, wherein the mounting bracket has an annular groove being formed around the external surface of the mounting bracket between the front end and the rear end; and a belt being mounted around the annular groove; and the external surface of the mounting bracket being octagonal.

* * * * *